US010548363B2

(12) United States Patent
Pritz et al.

(10) Patent No.: US 10,548,363 B2
(45) Date of Patent: Feb. 4, 2020

(54) HELMET DAMPENING FIT SYSTEM

(71) Applicant: Bell Sports, Inc., Scotts Valley, CA (US)

(72) Inventors: Ben D. Pritz, Santa Cruz, CA (US); Samuel J. Shaffer, Santa Cruz, CA (US)

(73) Assignee: BELL SPORTS, INC., Scotts Valley, CA (US)

( * ) Notice: Subject to any disclaimer, the term of this patent is extended or adjusted under 35 U.S.C. 154(b) by 563 days.

(21) Appl. No.: 14/833,779

(22) Filed: Aug. 24, 2015

(65) Prior Publication Data

US 2017/0055623 A1 Mar. 2, 2017

(51) Int. Cl.
*A42B 3/14* (2006.01)

(52) U.S. Cl.
CPC ..... *A42B 3/145* (2013.01); *A42B 3/142* (2013.01)

(58) Field of Classification Search
CPC .... A42C 5/02; A42C 5/00; A42C 5/04; A42B 1/22; A42B 1/062; A42B 1/067; A42B 1/064; A42B 1/241; A42B 7/00; A42B 1/008; A42B 1/06; A42B 1/063; A42B 1/24; A42B 1/248; A42B 1/002; A42B 1/004; A42B 1/006; A42B 3/145; A42B 3/142
USPC ..... 2/195.1, 175.1, 181, 417
See application file for complete search history.

(56) References Cited

U.S. PATENT DOCUMENTS

| | | | | | |
|---|---|---|---|---|---|
| 5,119,516 | A * | 6/1992 | Broersma | A42B 3/066 | 2/411 |
| 5,357,654 | A * | 10/1994 | Hsing-Chi | A42B 3/145 | 2/418 |
| 5,659,900 | A * | 8/1997 | Arney | A42B 3/085 | 2/181 |
| 5,794,272 | A * | 8/1998 | Workman | A42B 3/085 | 2/421 |
| 6,481,019 | B2 * | 11/2002 | Diaz | A41D 13/11 | 128/201.19 |
| 6,708,376 | B1 * | 3/2004 | Landry | A42B 3/145 | 2/418 |
| 7,222,374 | B2 | 5/2007 | Musal et al. | | |
| 8,032,993 | B2 * | 10/2011 | Musal | A42B 3/145 | 2/418 |
| 2005/0262619 | A1 * | 12/2005 | Musal | A42B 3/08 | 2/421 |

(Continued)

*Primary Examiner* — Alissa J Tompkins
*Assistant Examiner* — Catherine M Ferreira
(74) *Attorney, Agent, or Firm* — Walter M. Egbert, III; Gerard M. Donovan; Reed Smith LLP

(57) ABSTRACT

A fit system for a helmet can include an adjuster including a width adjustment track, and first and second pods moveably coupled to the width adjustment track with a first and second support arm, the second pod comprising a lateral offset from the first pod. The fit system can further include a dial moveably coupled to the adjustor, such that movement of the dial changes a size of the lateral offset between the first pod and the second pod. The fit system can further include a hanger flexibly coupled to both the first pod and the second pod and adapted to allow for adjustment of the lateral offset between the first pod and the second pod. The hanger can further be adapted to allow for movement of the first pod and the second pod in a direction substantially perpendicular to the lateral offset without movement of the dial.

17 Claims, 10 Drawing Sheets

(56) References Cited

U.S. PATENT DOCUMENTS

| | | | | |
|---|---|---|---|---|
| 2010/0050324 | A1 | 3/2010 | Musal | |
| 2010/0170068 | A1* | 7/2010 | Musal | A42B 3/145 24/68 D |
| 2013/0239303 | A1 | 9/2013 | Cotterman | |
| 2013/0263363 | A1* | 10/2013 | Pietrzak | A42B 3/28 2/411 |
| 2014/0109301 | A1 | 4/2014 | Hall | |
| 2015/0026871 | A1 | 1/2015 | Gotti | |

* cited by examiner

HELMET DAMPENING FIT SYSTEM

TECHNICAL FIELD

This disclosure relates to a fit system configured to couple to a helmet, whereby the safety and comfort of the user are improved. The helmet fit system can be employed wherever a conventional helmet is used with additional benefits as described herein.

BACKGROUND

Protective headgear and helmets have been used in a wide variety of applications and across a number of industries including sports, athletics, construction, mining, military defense, and others, to prevent damage to a user's head and brain. Damage and injury to a user can be prevented or reduced by helmets that prevent hard objects or sharp objects from directly contacting the user's head. Damage and injury to a user can also be prevented or reduced by helmets that absorb, distribute, or otherwise manage energy of an impact.

For helmet-wearing athletes in many applications, such as sports, beyond the safety aspects of the protective helmet, additional considerations can comprise helmet fit and airflow through the helmet. Improvements in fit comfort and airflow can reduce distractions to the athlete and thereby improve performance. The multi-body helmet construction and a strap attachment device, as disclosed in this document, relate to safety, as well as improvements in fit, airflow, and comfort without reducing safety for customers.

An aspect of providing a proper fit between a user's head and the helmet can comprise a fit system wrapping around the rear of the head near the occipital bun. Current fit systems can feel hot to the user because much or all of the fit system contacts the user's head, thereby reducing the area exposed to passing air that might otherwise cool the user's head. Moreover, further improvements in the way a fit system responds to movements or jarring will improve comfort for the user.

SUMMARY

A need exists for an improved helmet fit system and method for providing the same. Accordingly, in an aspect, a helmet can comprise a fit system for a helmet can comprise an adjuster comprising a width adjustment track, a first pod moveably coupled to the width adjustment track with a first support arm, a second pod moveably coupled to the width adjustment track with a second support arm, the second pod comprising a lateral offset from the first pod, a dial moveably coupled to the adjustor, the first pod, and the second pod, such that movement of the dial changes a size of the lateral offset between the first pod and the second pod, and a hanger flexibly coupled to both the first pod and the second pod and adapted to allow for adjustment of the lateral offset between the first pod and the second pod. The hanger can be coupled to the adjustor through the support arms and can be adapted to allow for movement of the first pod and the second pod in a direction substantially perpendicular to the lateral offset without movement of the dial.

The helmet can further comprise the first support arm comprising a first end coupled to an outer portion of the first pod and a second end opposite the first end cantilevered away from the first pod and coupled to the width adjustment track, and the second support arm comprising a first end coupled to an outer portion of the second pod and a second end opposite the first end cantilevered away from the second pod and coupled to the width adjustment track. The hanger can comprise a first portion coupled to an inner portion of the first pod, and the hanger can comprise a second portion coupled to an inner portion of the second first pod. The fit system can further comprise a belt adapted to be coupled to a helmet, the belt being adjustably coupled to the dial such that the movement of the dial changes a position of the belt with respect to the dial and further changes an adjustable inner circumference of the fit system. The lateral offset between the first pod and the second pod can comprise a distance in a range of 0-70 millimeters. The movement of the first pod and the second pod can be in a direction substantially perpendicular to the lateral offset and can comprise a distance in a range of 0-30 millimeters. A relative angle between the first pod and the first support arm can be measured in a plane comprising the lateral offset, wherein the relative angle comprises an angle in a range of 0-60 degrees.

In other aspects, a fit system for a helmet can comprise an adjuster comprising a width adjustment track, a first pod moveably coupled to the width adjustment track with a first support arm, a second pod moveably coupled to the width adjustment track with a second support arm, the second pod comprising a lateral offset from the first pod, a dial moveably coupled to the adjustor, the first pod, and the second pod, such that movement of the dial changes a size of the lateral offset between the first pod and the second pod, and a hanger flexibly coupled to both the first pod and the second pod and adapted to allow for adjustment of the lateral offset between the first pod and the second pod.

The fit system can further comprise the first support arm comprising a first end coupled to the first pod and a second end opposite the first end cantilevered away from the first pod and coupled to the width adjustment track, and the second support arm comprising a first end coupled to the second pod and a second end opposite the first end cantilevered away from the second pod and coupled to the width adjustment track. A belt can be adapted to be coupled to a helmet, the belt being adjustably coupled to the dial such that the movement of the dial changes a position of the belt with respect to the dial and further changes an adjustable inner circumference of the fit system. The lateral offset between the first pod and the second pod can comprise a distance in a range of 0-70 millimeters. A relative angle between the first pod and the first support arm can be measured in a plane comprising the lateral offset, wherein the relative angle comprises an angle in a range of 0-60 degrees. The fit system can further comprise a first pad coupled to a front surface of the first pod, and a second pad coupled to a front surface of the second pod. The first pod and the second pod can be adapted to move in a direction substantially perpendicular to the lateral offset for a distance in a range of 0-30 millimeters.

In yet other aspects, a fit system for a helmet can comprise an adjuster, a first pod moveably coupled to the adjuster with a first support arm, a second pod moveably coupled to the adjuster with a second support arm, the second pod comprising a lateral offset from the first pod, and a hanger flexibly coupled to both the first pod and the second pod and adapted to allow for adjustment of the first pod and the second pod in a direction substantially perpendicular to a rearmost surface of a head of a user.

The fit system can further comprise the first support arm comprising a first end coupled to the first pod and a second end opposite the first end cantilevered away from the first pod and coupled to the adjuster, and the second support arm comprising a first end coupled to the second pod and a second end opposite the first end cantilevered away from the second pod and coupled to the adjuster. The hanger can comprise a first portion coupled to the first pod, and a second portion coupled to the second first pod. The fit system can further comprise a dial moveably coupled to the adjustor, and a belt adapted to be coupled to a helmet, the belt being adjustably coupled to the dial such that the movement of the dial changes a position of the belt with respect to the dial and further changes an adjustable inner circumference of the fit system. The movement of the first pod and the second pod in the direction substantially perpendicular to the rearmost surface of the head of the user can comprise a distance in a range of 0-30 millimeters. A relative angle between the first pod and the first support arm can be in a range of 0-60 degrees.

Aspects and applications of the disclosure are described below with reference to the DRAWINGS and the DETAILED DESCRIPTION. Unless specifically noted, the words and phrases in the specification and the claims should be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly comprise additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

DETAILED DESCRIPTION

Figure 1:
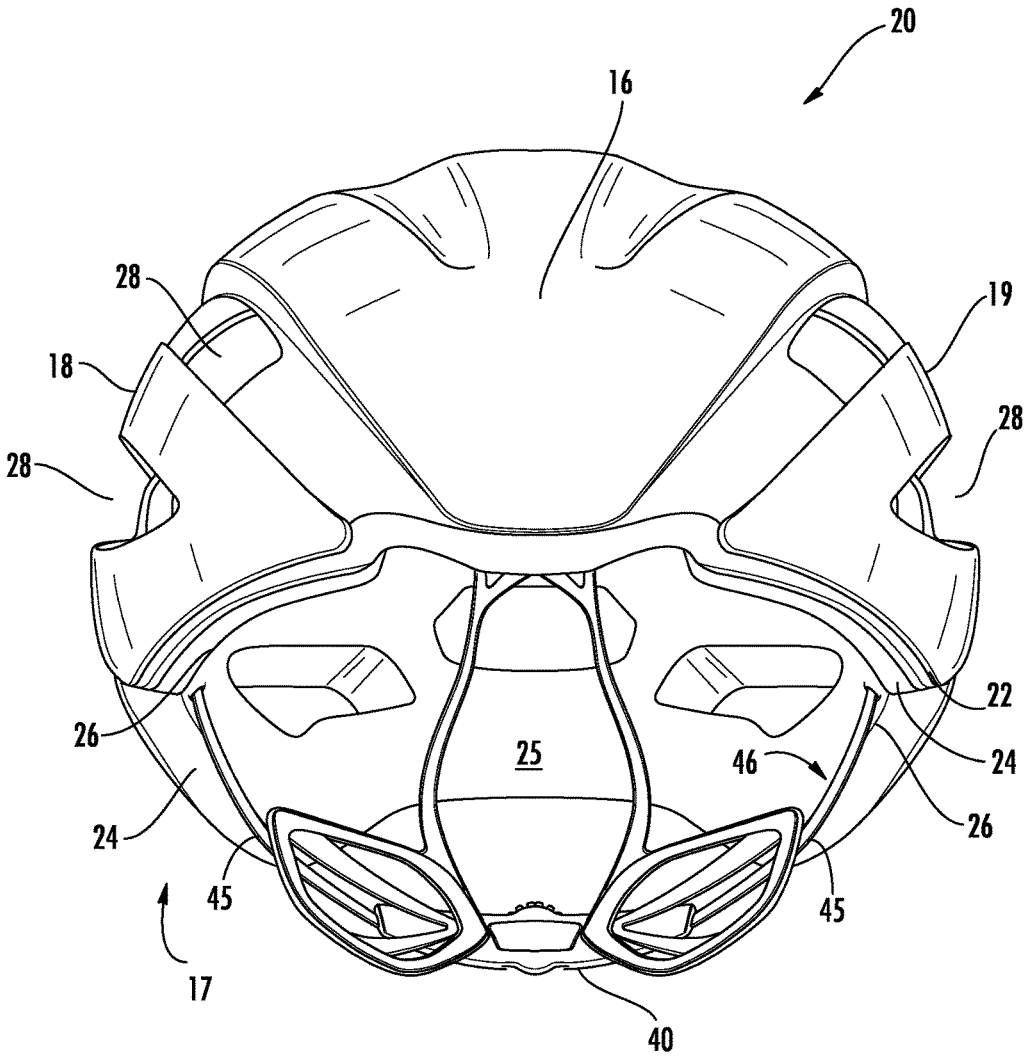
FIG. 1 depicts a front perspective view of a helmet comprising a dampening fit system.

This disclosure, its aspects and implementations, are not limited to the specific helmet or material types, or other system component examples, or methods disclosed herein. Many additional components, manufacturing and assembly procedures known in the art consistent with helmet manufacture are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure comprises a number of embodiments in many different forms, there is shown in the drawings and will herein be described in detail, particular embodiments with the understanding that the present disclosure is to be considered as an exemplification of the principles of the disclosed methods and systems, and is not intended to limit the broad aspect of the disclosed concepts to the embodiments illustrated.

This disclosure provides a device, apparatus, system, and method for providing a dampening fit system that can adjustably improve the fit of a protective helmet on a user's head. The protective helmet can be a bike helmet used for mountain biking or road cycling, as well as be used for a skier, skater, hockey player, snowboarder, or other snow or water athlete, a football player, baseball player, lacrosse player, polo player, climber, auto racer, motorcycle rider, motocross racer, sky diver or any other athlete in a sport. Other industries also use protective headwear, such that individuals employed in other industries and work such as construction workers, soldiers, fire fighters, pilots, or types of work and activities can also use or be in need of a safety helmet, where similar technologies and methods can also be applied. Each of the above listed sports, occupations, or activities can use a helmet that comprises either single or multi-impact rated protective material base that is typically, though not always, covered on the outside by a decorative cover and comprises comfort material on at least portions of the inside, usually in the form of comfort padding.

Generally, protective helmets, such as the protective helmets listed above, can comprise an outer shell and in inner energy-absorbing material. For convenience, protective helmets can be generally classified as either in-molded helmets or hard shell helmets. In-molded helmets can comprise one layer, or more than one layer, comprising a thin outer shell, an energy-absorbing layer or impact liner, and a comfort liner or fit liner. Hard-shell helmets can comprise a hard outer shell, an impact liner, and a comfort liner. The hard outer shell can be formed by injection molding and can comprise Acrylonitrile-Butadiene-Styrene (ABS) plastics or other similar or suitable material. The outer shell for hard-shell helmets can be made hard enough to resist impacts and punctures, and to meet the related safety testing standards, while being flexible enough to deform slightly during impacts to absorb energy through deformation, thereby contributing to energy management. Hard-shell helmets can be used as skate bucket helmets, motorcycle helmets, snow and water sports helmets, football helmets, batting helmets, catcher's helmets, hockey helmets, and can be used for BMX riding and racing. While various aspects and implementations presented in the disclosure focus on embodiments comprising in-molded helmets, the disclosure also relates and applies to hard-shell helmets.

Fit systems comprising one or more adjusters may be added to a helmet to allow a user to adjust the fit or tension of the helmet according to preference. Some adjusters may require a user to remove the helmet to make the adjustment, and some adjusters may require a user to use two hands to adjust the fit system—both of which can pose safety risks to a user wanting to adjust the fit system while in motion, such as riding a moving bicycle.

Figure 2:
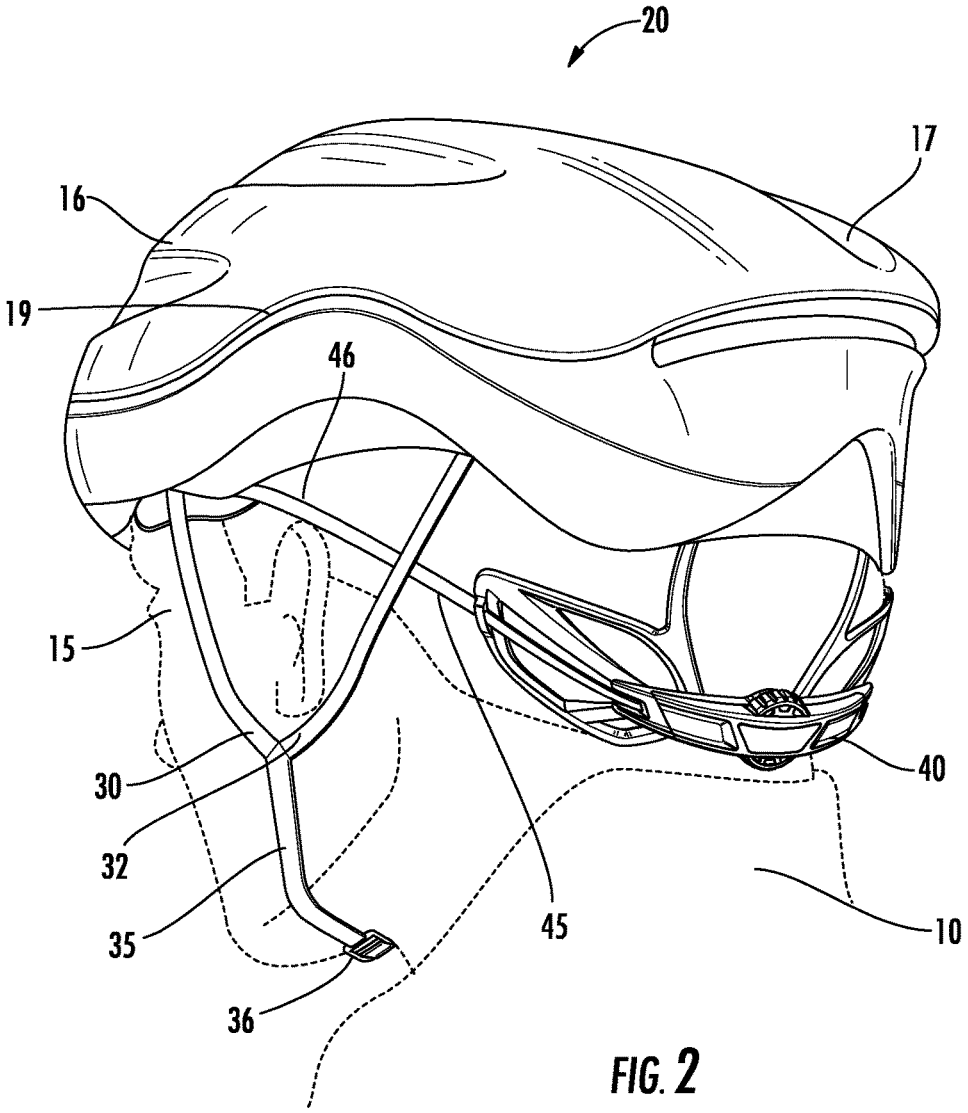
FIG. 2 depicts a rear perspective view of a helmet comprising a dampening fit system.

FIGS. 1 and 2 depict front and rear perspective views of a non-limiting example of a helmet or protective helmet 20. Helmet 20, for convenience and ease of description, and not by way of limitation, can be described as comprising an interior 25, a front portion 16, a rear portion 17, a right portion 18, and a left portion 19, wherein the relative descriptors of front, rear, right, and left, are given relative to a position of a user wearing helmet 20. Helmet 20 can provide energy management in controlling and directing energy resulting from collisions, impacts, and a rider falling, such as falling off, or with, a bicycle, skateboard, skis, or other sporting equipment, and coming into contact with any other object. A proper and secure fit for helmet 20 can improve or optimize energy management for the user 10 during collisions and impacts. Helmet 20 may be releasably coupled to a head of the user 10 so as to remain in place while fitting in a manner that provides user 10 both comfort and aerodynamic performance. Various users 10 will have a variety of differing head shapes and sizes 15. In addition to the shape of helmet 20 and the shape of interior 25, a shape and position of dampening fit system or occipital dampening fit system 40, straps 30 and 32, and chin straps 35 can together, help determine the overall fit of helmet 20 on the head 15 of user 10.

The helmet 20 can further comprise an outer shell 22 and an energy-absorbing layer or impact liner 24, although the helmet 20 need not comprise both. For example, in some embodiments the helmet 20 can comprise the impact liner 24 without the outer shell 22. Vents or openings 28 can be formed in the impact liner 24 and outer shell 22 to help air circulate near the head 15 of user 10, to improve ventilation, and to cool user 10. The outer shell 22 can, without limitation, be formed of a plastic, resin, fiber, or other suitable material comprising polycarbonate (PC), polyethylene terephthalate (PET), acrylonitrile butadiene styrene (ABS), polyethylene (PE), polyvinyl chloride (PVC), vinyl nitrile (VN), fiberglass, carbon fiber, or other similar material. The outer shell 22 can be stamped, in-molded, injection molded, vacuum formed, or formed by another suitable process. Outer shell 22 can provide a shell into which the impact liner 24 can be in-molded. Outer shell 22 can also provide a smooth aerodynamic finish, a decorative finish, or both, for improved performance, improved aesthetics, or both. As a non-limiting example, the outer shell 22 can comprise PC shells that are in-molded in the form of a vacuum formed sheet, or are attached to the impact liner 24 with an adhesive. The outer shell 22 can also be permanently or releasably coupled to the impact liner 24 using any suitable chemical or mechanical fastener or attachment device or substance comprising without limitation, an adhesive, permanent adhesive, pressure sensitive adhesive (PSA), foam-core adhesive, tape, two-sided tape, mounting foam adhesive, fastener, clip, cleat, cutout, tab, snap, rivet, hog ring, or hook and loop fasteners.

The impact liner 24 can be disposed inside, and adjacent, the outer shell 22. The impact liner 24 can be made of plastic, polymer, foam, or other suitable energy-absorbing material or impact liner to absorb, deflect, or otherwise manage energy and to contribute to energy management for protecting the user 10 during impacts. The impact liner 24 can comprise, without limitation, expanded polystyrene (EPS), expanded polypropylene (EPP), expanded polyolefin (EPO), expanded polyurethane (EPU), Vinyl Nitrile (VN), and Ethylene Vinyl Acetate Copolymer (EVA), or other similar or suitable material. In general, in-molded helmets can be formed with the outer shell of the helmet being bonded directly to the impact liner/energy-absorbing layer by expanding foam into the outer shell. As such, the impact liner 24 can, in some embodiments, be in-molded into outer shell 22 as single monolithic bodies of energy-absorbing material. Alternatively, in other embodiments the impact liner 24 can be formed of multiple portions or a plurality of portions. In any event, the impact liner 24 can absorb energy from an impact by bending, flexing, crushing, or cracking.

Helmet 20 can comprise, or be coupled to, a dampening fit system 40, front straps 30 anchored to the front portion 16, and rear straps 32 anchored to the rear portion 17. First or top ends of the straps 30 and 32 can be permanently or releasably coupled to the helmet 20, such as the interior 25 of the helmet 20, with any suitable fixed or adjustable fasteners, including one or more snaps, clasps, locks, flanges, receivers, tabs, detents, slots, rods, hooks, buttons, keys, knobs, notches, gates, latches, adhesive, clips, cleats, cutouts, rivet, hog rings, friction fits based on geometries of the elements, or other suitable fastening devices. Second or bottom ends of the straps 30 and 32 opposite the first or top ends of the straps 30 and 32 can be joined or converge on each side of helmet 20 to form chin straps 35. Each chin strap 35 can be coupled to interlocking, mateable, or releasably coupling portions of buckle 36, such as a male or female portion of the buckle 36. When the interlocking portions of the buckle 36 are coupled while the user 10 is wearing helmet 20, chin straps 35 can form a loop under the chin of user 10.

The helmet 20 can further comprise, or be coupled to, dampening fit system 40. The dampening fit system 40 can comprise frame 50 and adjuster 60, which can include base or adjuster housing base 62, support arms, fit system arms or flex arms 55; pods or pad assemblies 52; a dial or adjustment wheel 65, and pads or padding 65, which are discussed in greater detail below. The dampening fit system can also optionally comprise belts 45 with an adjustable inner circumference 46 and normal distance or offset 48. The dampening fit system 40 can be made of or comprise one or more durable flexible materials comprising polymers or thermoplastics such as ABS, fluoropolymers, polyacetal, polyamide; polycarbonate, polyethylene, polysulfone, or the like. Dampening fit system 40 can be coupled to the helmet 20 with one or more belts 45, such as a left side or left belt 45*a* and a right side or right belt 45*b* and with a bridge fastener 57. While FIG. 1 shows two belts 45, or a single belt 45 comprising left side 45*a* and a right side 45*b*, in other instances, belts 45 can comprise any number of belts, such as three, four, or more belts. The belts 45 can be coupled to the interior 25 of helmet 20 to provide of an adjustable inner circumference 46 that will allow the helmet 20 to be firmly and comfortably coupled to heads 15 of various sizes belonging to a plurality of users 10. The belts 45 can be coupled to the helmet 20, including along a portion of the interior 25 of the helmet, such as at or near the inner rim 26 of the helmet 20 at the front portion 16 of the helmet 20. In various instances, the belt 25 can be coupled within a front half, a front two-thirds, a front three-fourths, or a middle portion of the helmet 20.

Figure 3A:
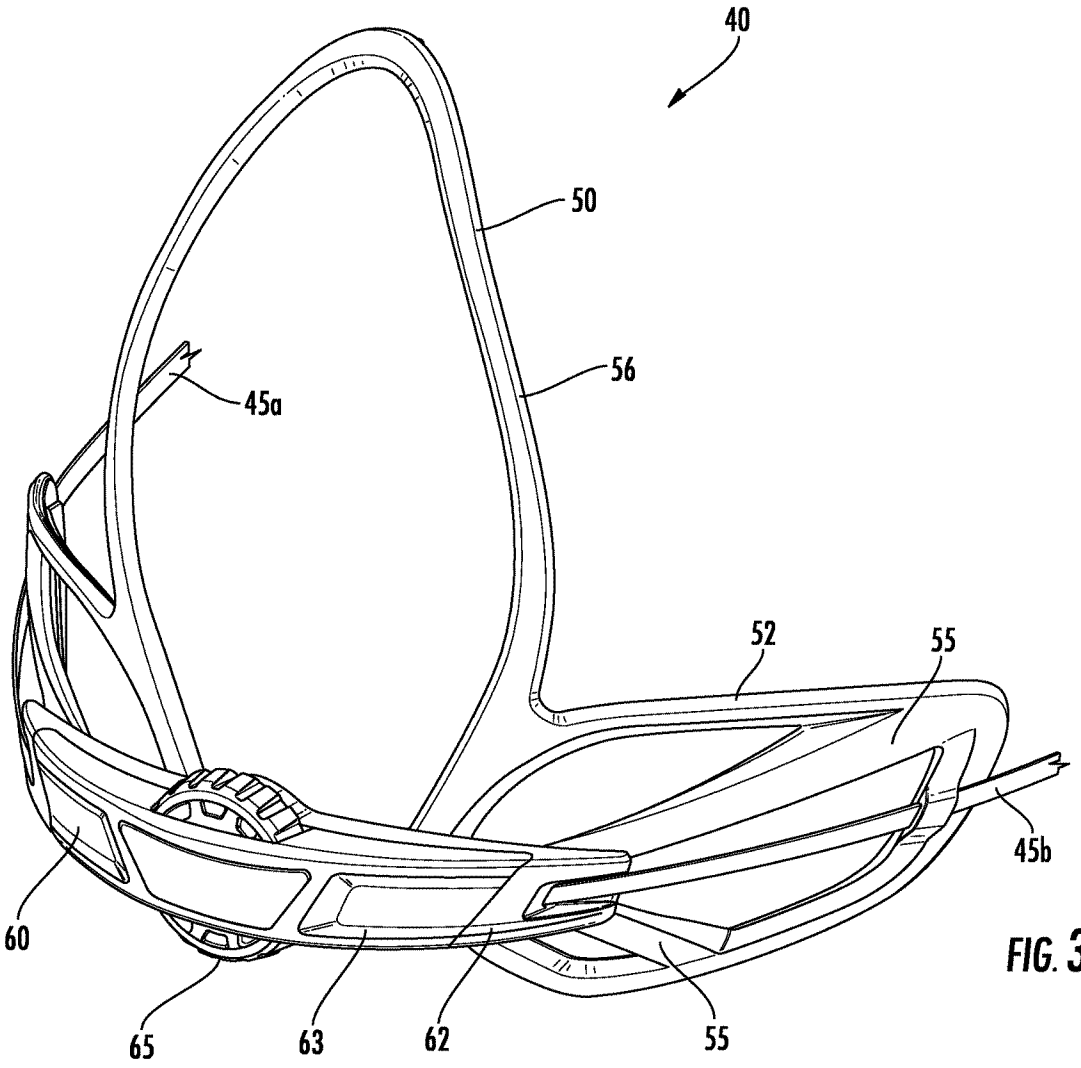
FIGS. 3A and 3B show perspective views of front and rear portions of a dampening fit system.
Figure 3B:
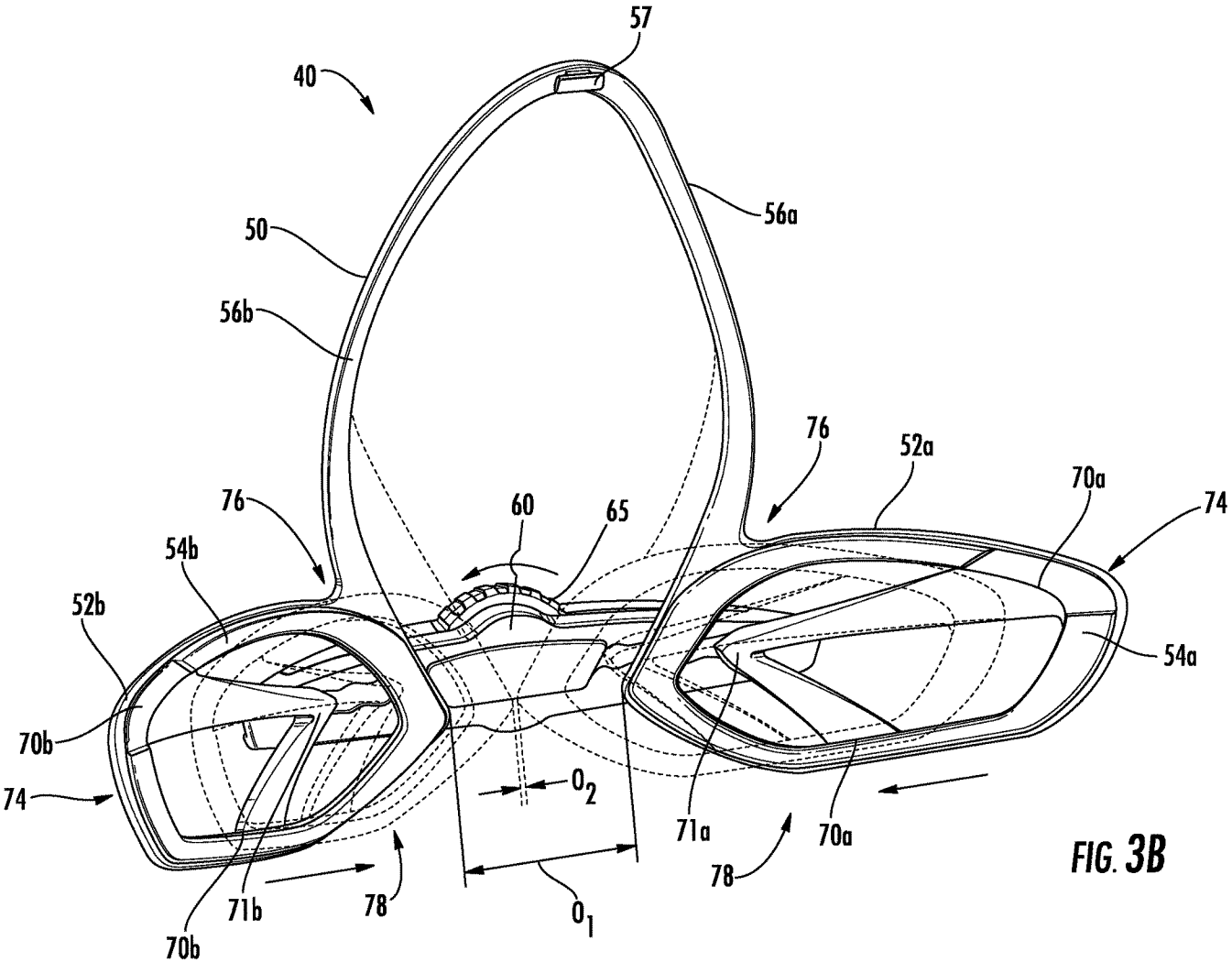

In addition to the dampening fit system 40 being coupled to the helmet 20 through the belts 45, the dampening fit system 40 can also be coupled to the helmet 20, with a bridge fastener 57, which is obscured in FIG. 1, but shown in FIG. 3B. The bridge fastener 57 can be coupled to the interior 25 of the helmet 20, at the rear portion 17 of the helmet 20, at the inner rim 26, generally near the top of the user's head 15, or between the inner rim 26 and the top of the user's head 15.

The belt 45, as well as the bridge fastener 57, can be coupled to the interior 25 of the helmet 20 with any suitable fixed or adjustable fasteners, including one or more snaps, clasps, locks, flanges, receivers, tabs, detents, slots, rods, hooks, buttons, keys, knobs, notches, gates, latches, adhesive, clips, cleats, cutouts, rivet, hog rings, friction fits based on geometries of the elements, or other suitable fastening devices. In some embodiments, one or more of the belts 45 and the bridge fastener 57 can be fixedly fastened to the interior 25 of helmet 20. In other embodiments, the belts 45 can be fixedly fastened to the interior 25 of helmet 20, while the bridge fastener 57 can be adjustable in a forward and backward fashion, thereby raising or lowering the dampening fit system 40. In further embodiments the bridge fastener 57 can be fixedly fastened to the interior 25 of helmet 20, while each belt 45 can be adjustable in a forward and backward fashion, thereby pulling or pushing the dampening fit system 40 forward or backward. In still other embodiments, both the belts 45 and the bridge fastener 57 can be adjustably fastened to the interior 25 of helmet 20.

Figure 4A:
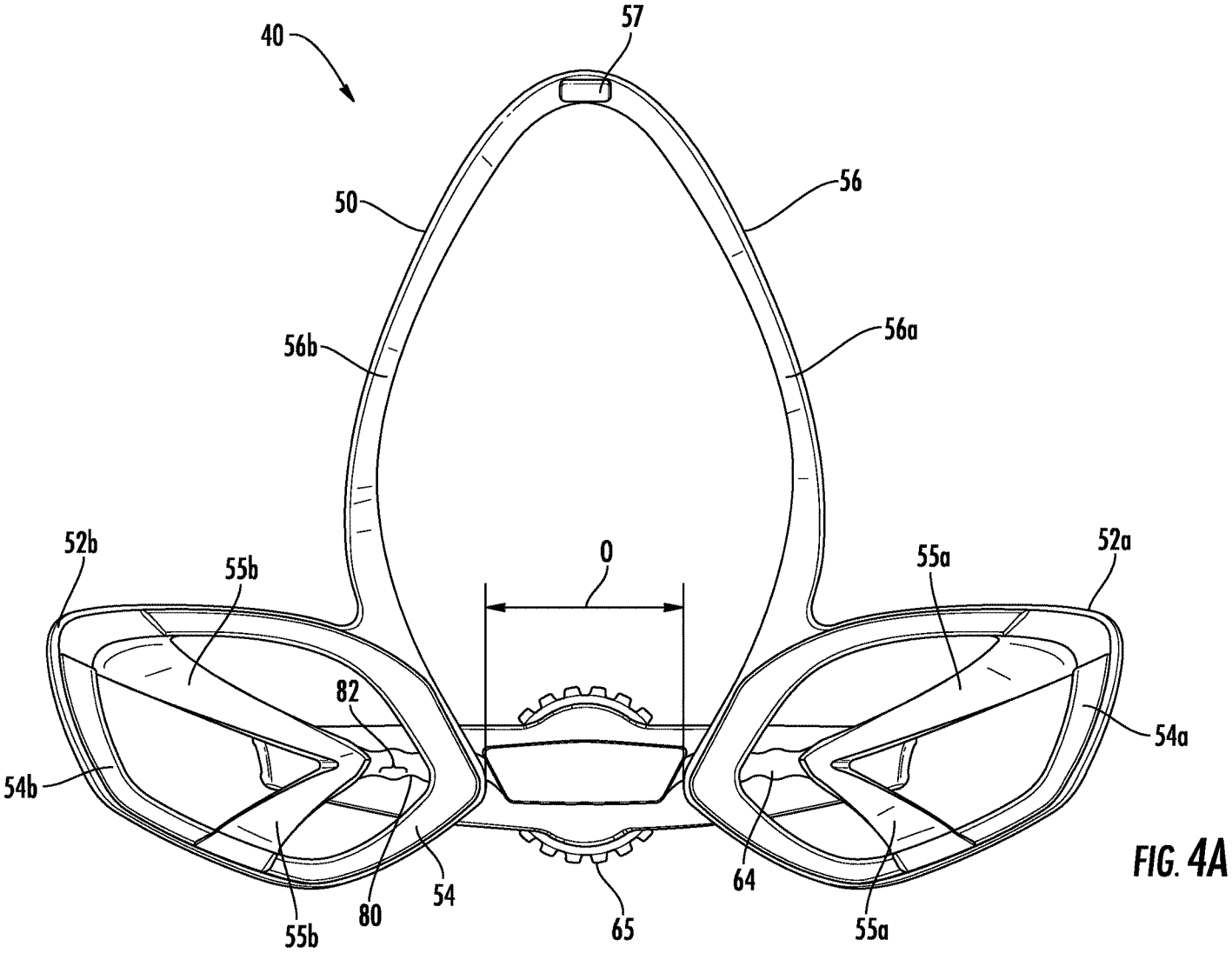
FIGS. 4A-4D show various views of the dampening fit system.
Figure 4B:
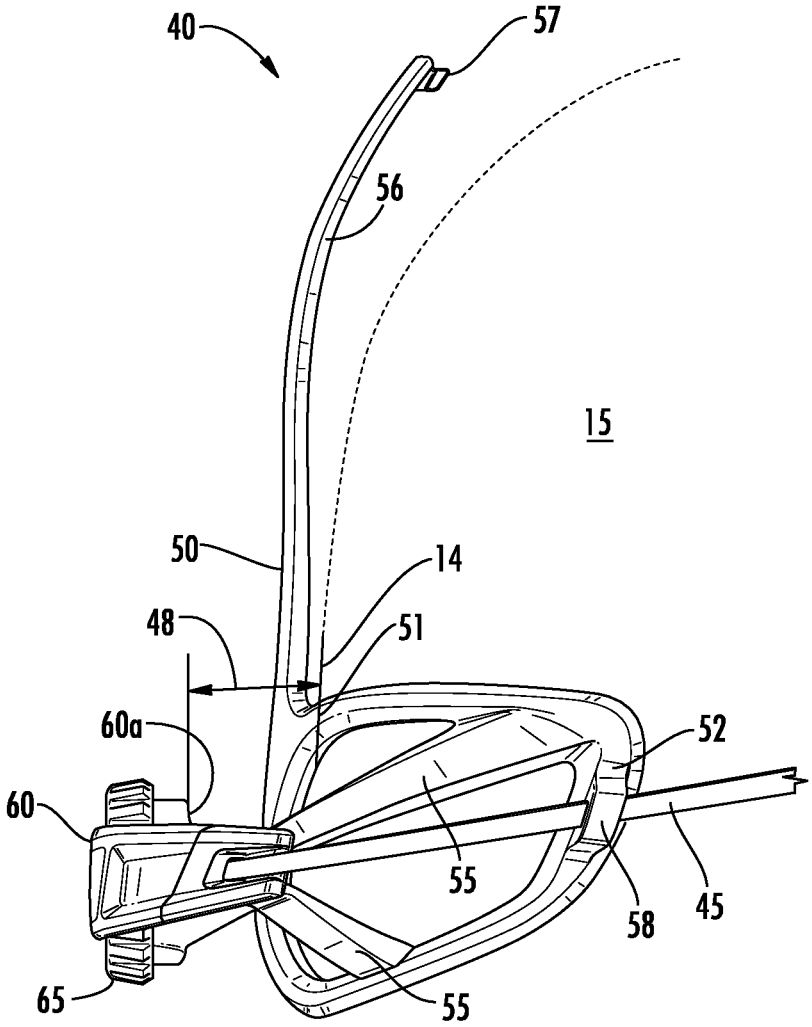
Figure 4C:
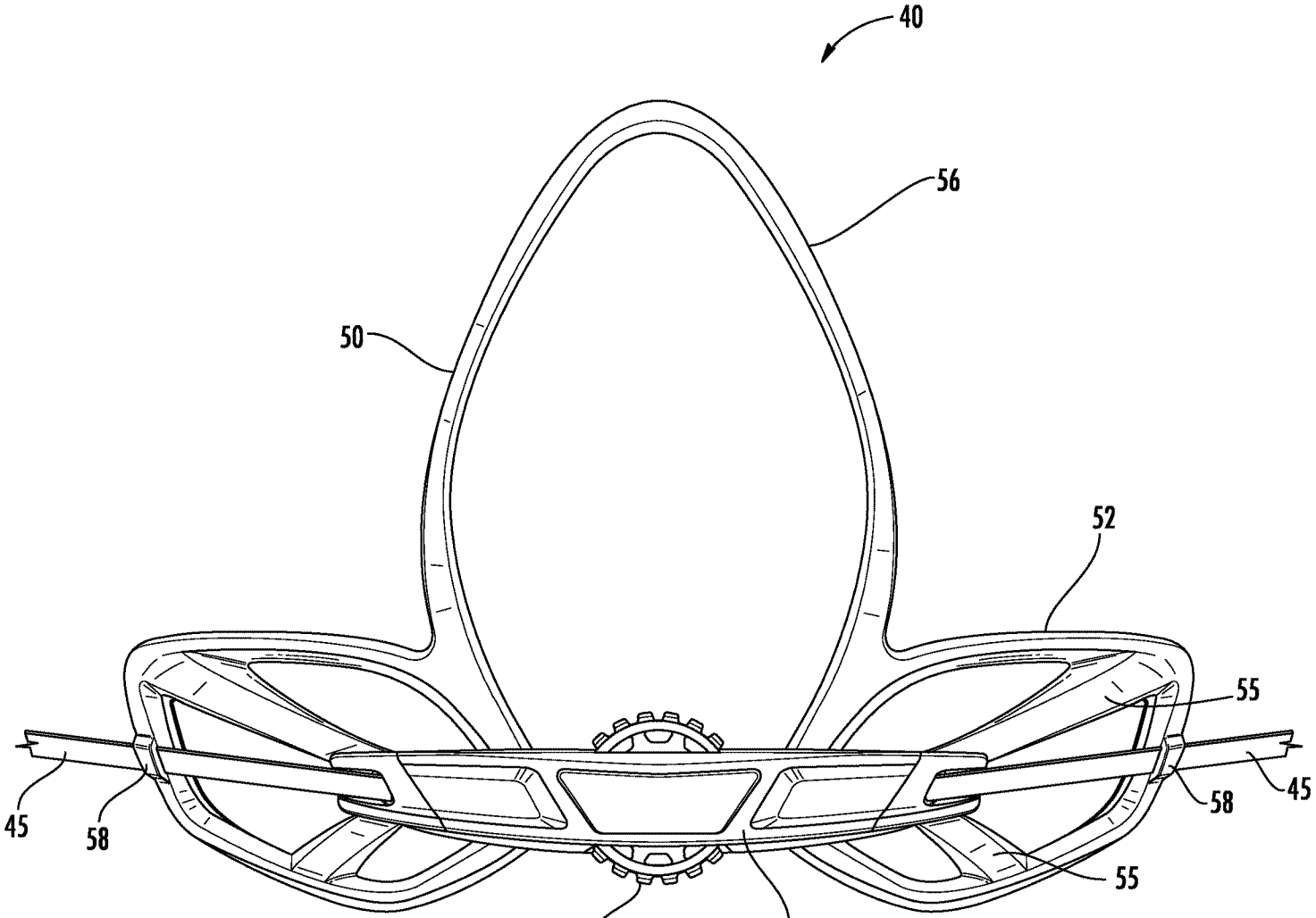
Figure 4D:
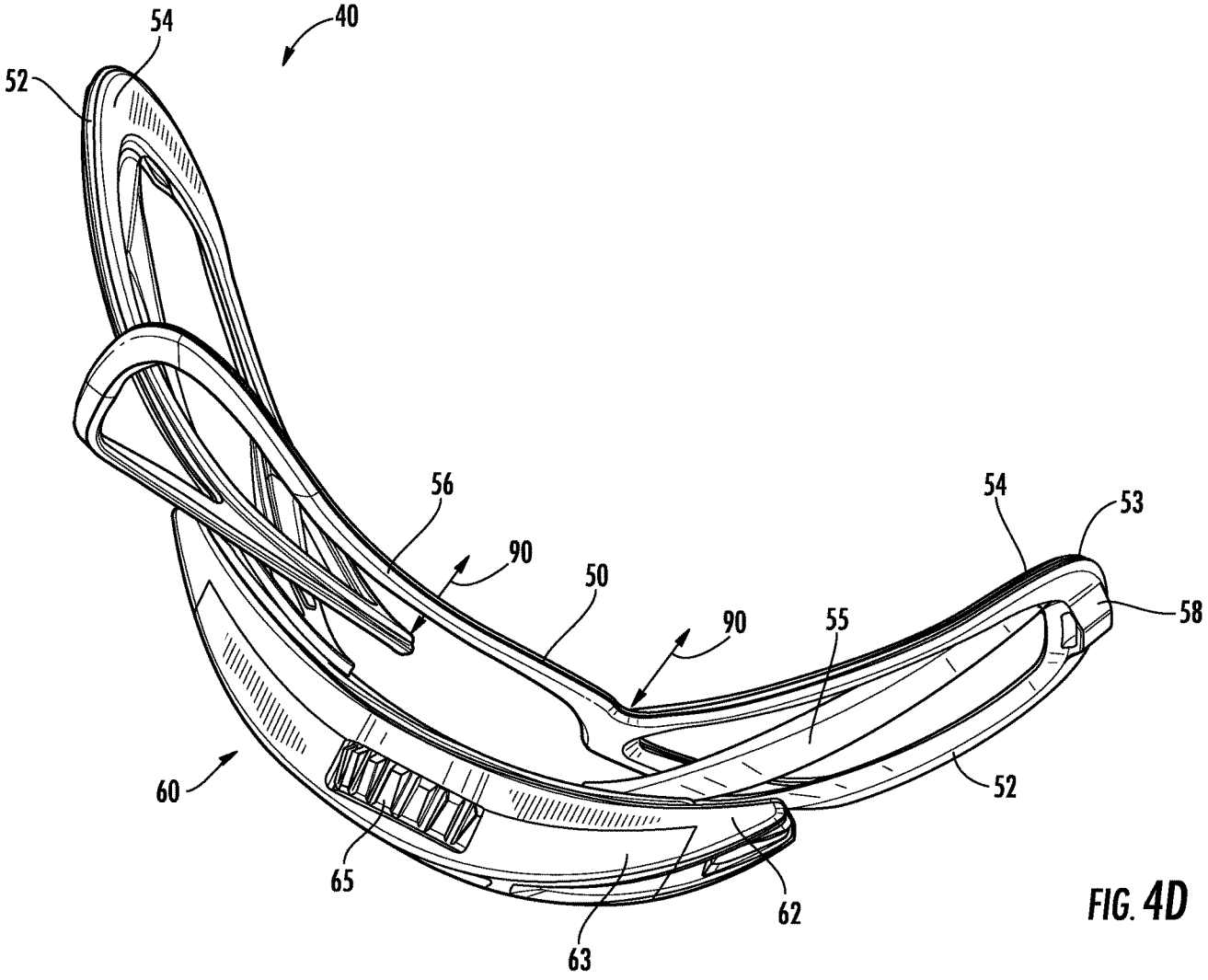

FIGS. 3A, 3B, and 4A-4D show additional detail of how the dampening fit system 40 can be configured for use with a helmet 20. More specifically, FIG. 3A shows a back perspective view of the dampening fit system 40, and FIG. 3B shows a front perspective view of the dampening fit system 40, opposite the back view of FIG. 3A. FIG. 3B also provides additional detail of how the dampening fit system can move and be adjusted with the dashed or phantom lines and the arrows showing relative movement of the dampening fit system 40. Similarly, FIG. 4A shows a profile view of a front or inside portion of the dampening fit system 40, FIG. 4B shows a profile view of a right side or portion of the dampening fit system 40, taken perpendicular to the view of FIG. 4A. FIG. 4C shows a profile view of a back or rear portion of the dampening fit system 40, opposite the view shown in FIG. 4A. FIG. 4D shows a perspective view of a top and rear portion of the dampening fit system 40.

The dampening fit system 40 can comprise an adjuster 60 coupled to belts 45 and to a frame 50. The adjuster 60 can comprise a housing base 62 and a cover or adjuster housing cover 63 that partially encloses a dial or adjustment wheel 65. The dampening fit system 40 can further comprise a frame 50 that can further comprise pods 52; pads or padding 54; support arms, fit system arms, or flex arms 55; arm fasteners 59 (see FIG. 5), a hanger or bridge 56, a hanger or bridge fastener 57, and belt guides 58.

The dampening fit system 40 can be configured to fit and conform to a back of the head 15 of user 10 where pads 54 can rest against the back of head 15, approximately laterally below the occipital portion of the head 15. Providing support against the lower back portion of head 15 can improve both a static and dynamic fit of helmet 20 by providing resistance to the helmet 20 shifting forwards. As static fit of the helmet 20 can be improved by allowing a stationary or statically resting helmet adapt to differences in user head shape and head size. A dynamic fit of the helmet 20 can be improved by providing cushioning, dampening, or both, that results from vibration or movement of the user, the helmet, or both, while the user is moving, or while external forces, such as wind, are acting on the helmet 20.

The adjuster 60 can adjust, and can be configured to adjust, the fit of the dampening fit system 40 by rotating dial 65 in order to increase the offset, lateral offset, or distance O between support arms 55 and pods 52. For example, rotating dial 65 towards the right ear of user 10, to the right, or clockwise can cause arms 55 and the pods 52 to move closer together, as depicted in FIG. 3B to decrease a size of offset O, such as decreasing the offset O from a large or maximum offset O1 to a small or minimum offset O2. In some embodiments, the offset O can comprise distances or offsets in a range of 0-70 millimeters (mm), 2-70 mm, 0-50 mm, 2-50 mm, 5-50 mm, 0-30 mm, 2-30 mm, or 3-30 mm, 0-20 mm, or 2-20 mm. Similarly, rotating dial 65 as depicted in FIG. 3B towards the left ear of user 10, to the left, or counterclockwise, can cause the arms 55 and the pods 52 to move farther away from each other. In alternative embodiments, rotating dial 65 counterclockwise or to the left can move the arms 55, the pods 52 and the pads 54 closer together, while rotating dial 65 clockwise or to the right can move arms 55, pods 52, and pads 54 farther apart. In yet other embodiments, the dial 65 need not move rotationally, but can move linearly, such as left to right or forwards and backwards to actuate movement of the fit system 40, including support arms 55, pods 52, and belt 45. As support arms 55 and the pods 52 move closer together or farther apart, hanger 56, including left or first portion 56*a* of hanger 56 and right or second portion 56*b* of hanger 56 can bend, flex, or deform to allow for relative movement and changes in spacing or distance between the arms 55 and the pods 52, such as changes in the offset O.

In some instances, the dial 64 and the pods 52 can be separately adjustable such that the dial 65 can adjust only the relative position of the belt 45 with respect to the dial 64, thereby changing the size of the adjustable inner circumference 46 without adjusting a position of pods 52 within the width adjustment track 64 to change the offset O. The position of the pods 52 within the width adjustment track 64 can be independent of the dial 64 such that the position of the pods 52 are manually adjusted, such as by a hand or a person or user, with sufficient force to move the pods 52 past the detents 80 of the adjustment track 64.

In other instances, the dial 65 can simultaneously adjust both a position of pods 52 within the width adjustment track 64 to change the offset O, as well as adjusting a relative position of the belt 45 with respect to the dial 64 to change the size of the adjustable inner circumference 46. The size of the adjustable inner circumference 36 can vary to accommodate any size of user heads 15, including circumferences in a range of 45-65 centimeters (cm). In yet other instances, the dial 65 can adjust only a position of pods 52 within the width adjustment track 64 to change the offset O, without adjusting the relative position of the belt 45 with respect to the dial 64 to change the size of the adjustable inner circumference 46

The hanger 56 can be flexibly coupled to both the left pod or first pod 52*a* and the right pod or second pod 52*b* and adapted to allow for adjustment of the lateral offset O between the first pod 52*a* and the second pod 52. The hanger 56 can also be flexibly coupled to the adjuster 60 through the support arms 55 and be adapted to allow for movement or travel of the first pod 52*a* and the second pod 52*b* in a direction 90, shown for example in FIG. 4D, that is substantially perpendicular to the lateral offset O without movement of the dial 65. A distance of the movement in direction 90 can be about 5 mm, or in a range of 0-30 millimeters (mm), 2-30 mm, 5-30 mm, 0-20 mm, 2-20 mm, 5-20 mm, 0-10 mm, 2-10 mm, 5-10 mm, or other similar distance. The hanger 56 being flexibly coupled to the adjuster 60 through the pods 52 and the support arms 55 can also allow or provide for a normal distance or offset 48. The normal distance 48 can be measured as a distance between the front surface 60*a* of adjuster 60 and rearmost surface 14 of head 15 contacting pods 52. The normal distance 48 can also be measured as a distance between front surface 60*a* of adjuster 60 and portion 51 of pod 52 configured to receive rearmost portion 14 of head 15. The normal distance 48 can also be measured as a distance between front surface 60*a* of adjuster 60 and portion 51 of pad 54 configured to receive rearmost portion 14 of head 15. The normal distance 48 is illustrated, for example, in FIG. 4B. The normal distance 48 can be about 5 mm, or in a range of 2-30 mm, 5-30 mm, 2-20 mm, 5-20 mm, 2-10 mm, 5-10 mm, or other similar distance.

While the terms first and second are used herein for convenience, with respect to various element numbers and features, such as pods 52, front sides 53 of pods 52, pads 54, support arms 55, hanger 56, hanger fastener 57, first end 70 of support arm 55, second end 71 of support arm 55, outer portions 74 of pods 52, inner portions 76 of pods 52, and lower portions 78 of pods 52*b*, the designations of first and second are non-limiting and can be reversed.

Figure 5:
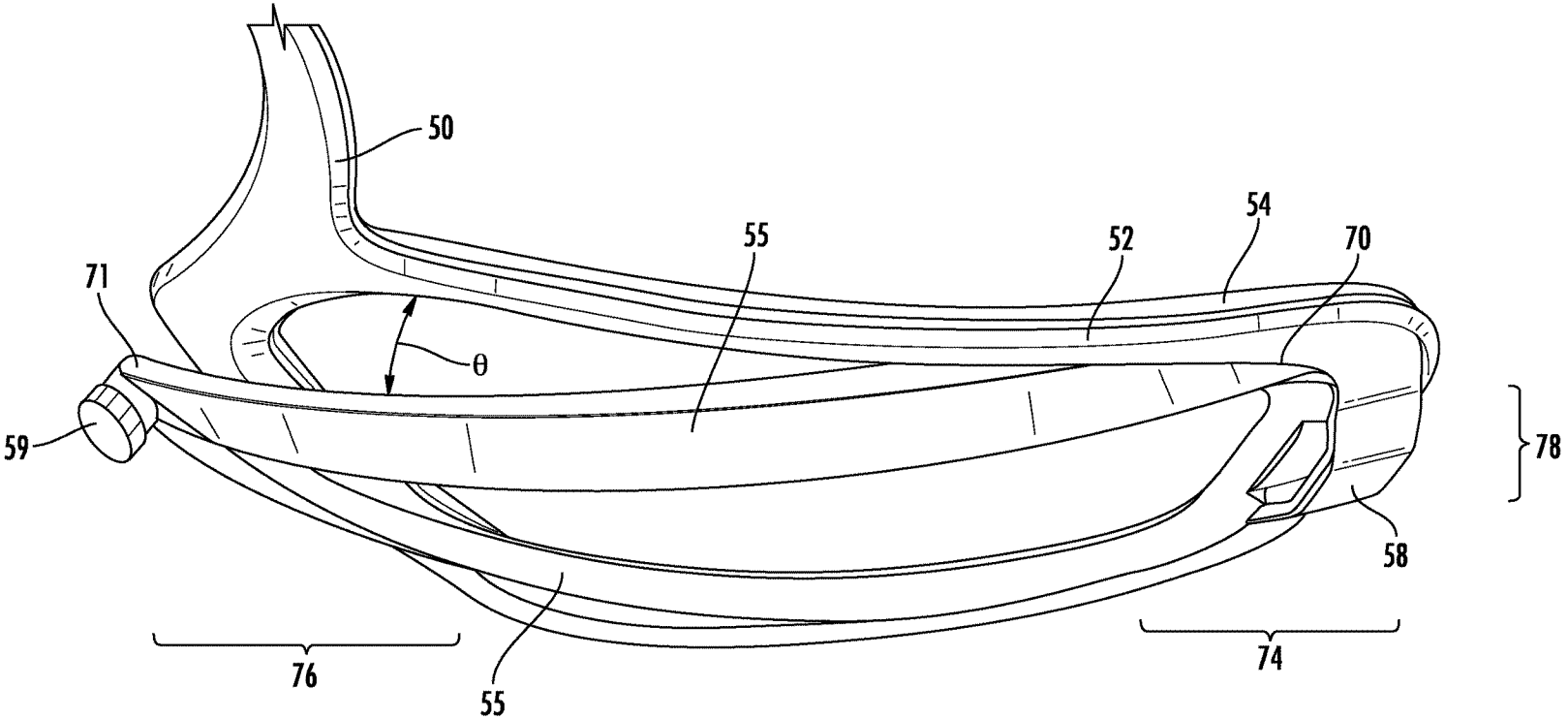
FIG. 5 shows a close-up view of part of the dampening fit system.

FIG. 5 illustrates a close-up view of the dampening fit system 40 according to certain non-limiting embodiments. Each support arm 55 can comprise a first end 70 that can be coupled to a pod 52 in a cantilevered fashion, as shown. Each support arm 55 can comprise a second end 71 of the support arm 55 opposite the first end 70 of the support arm 50 that comprises, or is coupled to, an arm fastener 59. The arm fastener 59 can comprise any suitable fixed or adjustable fasteners, including one or more snaps, clasps, locks, flanges, receivers, tabs, detents, slots, rods, hooks, buttons, keys, knobs, notches, gates, latches, adhesive, clips, cleats, cutouts, rivet, hog rings, friction fits based on geometries of the elements, or other suitable fastening devices. While the arm fastener 59 is shown at the second end 71 of the support arm 55, in some embodiments the arm fastener 59 can be coupled at a central portion of the support arm 55. The arm fastener can be adapted or configured to be releasably or permanently coupled to a portion of the adjuster 60, such as width adjustment track 64. The width adjustment track 64 can be configured to receive, or mateably couple with, a portion of the support arms 59. In some embodiments, the width adjustment track 64 can include a number of detents, prongs, bays, notches, compartments, or divots 80, that will allow, and are adapted to receive, the arm fasteners 59 at discrete or continuous increments, points, or offsets 82, such as at increments of every 5 mm, or other desirable distance, such as at 2 mm, 3 mm, 4 mm, 5 mm, 6 mm, 7 mm, 8 mm, 9 mm, or 10 mm, plus or minus up to 1 mm.

FIG. 5 also shows an angle θ that can be measured as the angle between the plane defined by pod 52 and the plane defined by support arm 55. Additionally, the angle θ can be measured as the relative angle between pod 52 and support arm 55 measured in a plane comprising the lateral offset O. The angle θ comprises an angle in a range of 2-60 degrees, 3-45 degrees, or about 4-18 degrees. While the angle θ can remain constant or substantially the same for a single user 10, while the user is in a single position, the angle θ can change when the rider changes position, such as going into a tucked riding position. For example, by going into a tucked position, a size or effective circumference of the head 15 of the user 10 can increase, and a smaller angle θ can accommodated the shift or increase in head size. Similarly, the angle θ can change among riders of different head shapes and sizes. For example, the angle θ can change and be larger for users 10 with rounder or more circular head shapes, and the angle θ can be larger for a more oval shaped head for a given or fixed offset O between pods 52.

Aside from the angle θ, the shape, length, and material selection for cantilevered support arm 55 and pod 52 may also affect the way movements are dampened by dampening fit system 40, the degree of improved air circulation, or both. In some instances, support arm 55 may be approximately 5 cm in length, or in a range of 2-7 cm in length. Pods 52 may be approximately 7 cm in length or in a range of 3-10 cm in length, and about 3.5 cm in height or in a range of about 2-5 cm in height. Each support arm 55 may comprise a single support arm 55, or may also comprise two or more support arms 55 coupled to the pods 52. As depicted in FIGS. 3-4, support arm 55 may comprise two arm members fixedly and flexibly coupled to the pods 52. Some embodiments employ two or more arm members of support arm 55 to provide increased strength, reduce the thickness of using one support arm 55, or both. Support arm 55 may be shaped in a tapered fashion and may be shaped aerodynamically. Support arms 55 may couple to pod 52 at or along the outer portion 74 of the pod 52, or at or along the lower portion 78 of the pod 52. The hanger or bridge 57 can be coupled to the inner portion 76 of the pods 52. Coupling of the support arms 55 and the hanger 57 can occur at a first quarter, half, or two-thirds of the respective portion of the pod 52.

Frame 50 may be constructed of one material, multiple materials, or composites of multiple materials. Frame 50 depicted in FIGS. 3-4 can be constructed of one or more durable flexible materials comprising polymers or thermoplastics such as ABS, fluoropolymers, polyacetal, polyamide; polycarbonate, polyethylene, polysulfone, or the like. Pads 54 can be coupled to the front sides 53 of the pods 52. The pads 54 can comprise a comfort pad made from foam or other padding material including EVA, textiles, or other suitable materials. Pads 54 can be designed to securely couple to pod 52 and provide a comfortable point of contact to the head 15 of the user 10. Pads 54 may be affixed or alternatively, may be removably coupled to pod 52 using adhesives, fasteners, buttons, compression, or the like. Pad 54 may be removable allowing, for example, the user 10 to wash pad 54.

Figure 6:
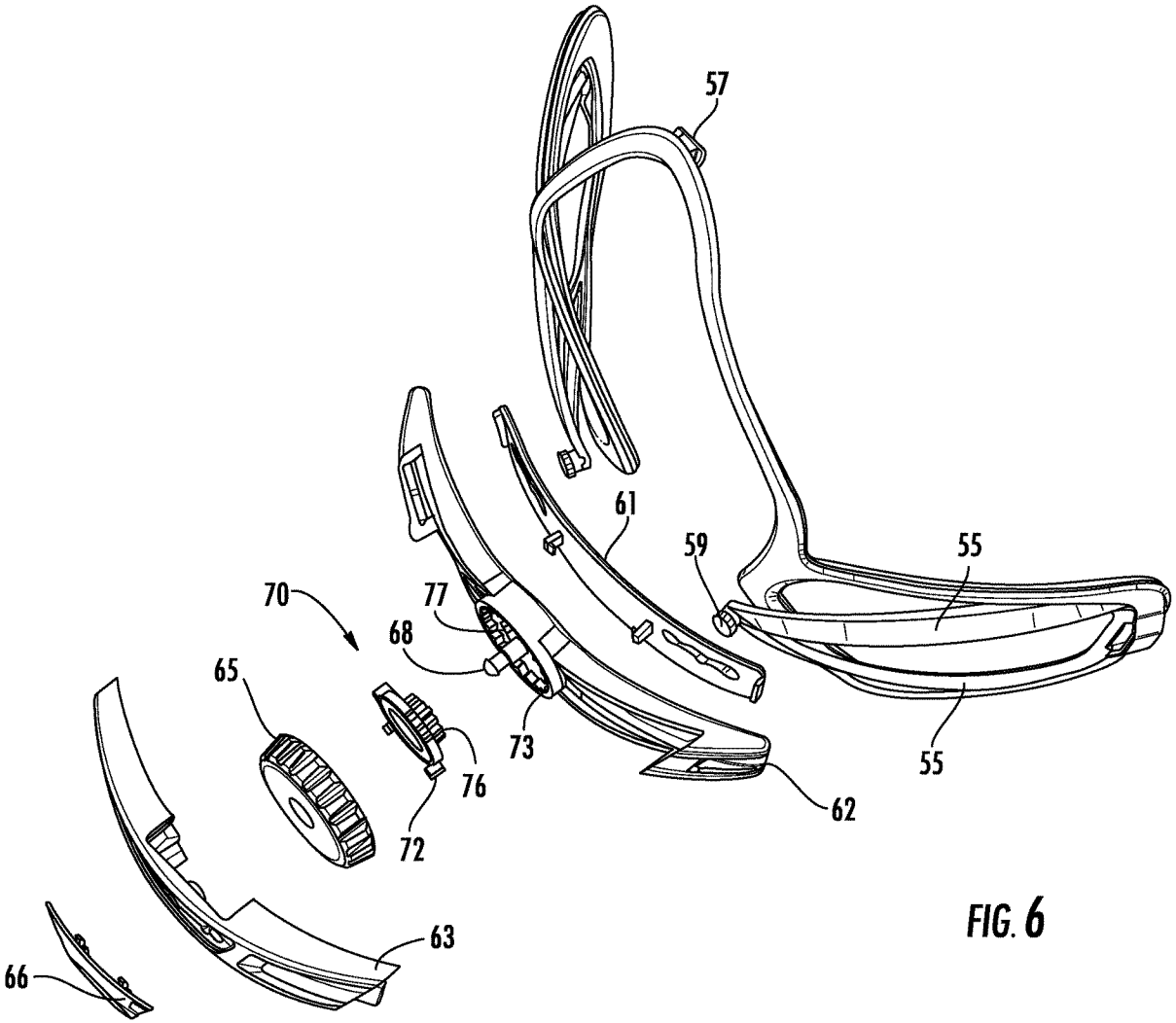
FIG. 6 shows an exploded perspective view of the dampening fit system.

FIG. 6 depicts an exploded perspective view of a non-limiting example of a dampening fit system 40 for use with a helmet 20. In addition to dial 65 and other elements described above, adjuster 60 may further comprise a housing base plate 61, width adjustment track or position slots 64, cap 66, post 68, actuator 70, drive dogs 72, outer female teeth 73, inner male teeth 76, and inner female teeth 77.

The adjuster 60 comprises teeth configured to prevent or limit slipping and loosening of the adjuster 60. The adjuster has a first, second, third, and fourth incremental notches to allow the user to tighten the adjuster, and for the adjuster to remain tight. Actuator 70 has drive dogs 72 that mate with outer female teeth 73, which are engaged when dial 65 is rotated clockwise (but not when dial 65 is rotated counter-clockwise). Actuator 70 also has inner male teeth 76 that mate with inner female teeth 77, which are engaged when dial 65 is rotated counter-clockwise (but not when dial 65 is rotated clockwise). Rotating dial 65 clockwise will move support arms 55 closer together while rotating dial 65 counter-clockwise will move support arms 55 farther apart (or vice-versa in alternative embodiments). The dampening fit system 40 that could be loosened incrementally, tightened incrementally, or both, proportionate to the distance the dial 65 is rotated, with the fit being retained when the dial 65 stops rotating. In some embodiments, the dial 65 can be rotated with one hand to tighten, loosen, or both, the dampening fit system 40. Fit can also be adjusted while the user 10 is wearing the helmet 20 in some embodiments.

In some embodiments, an adjuster 60 can be configured to tighten loosen, or both, a rack and pinion housed within adjuster 60 with a rotation of a dial 65 of the adjuster 60. Rotating the dial 65 in a first direction can tighten the rack, which can tighten the fit of the helmet 20. The adjuster 60 may also comprise teeth configured to prevent the mechanism from slipping and loosening the adjuster 60 when the user 10 wants it to remain tight. Rotating the dial 65 in a second direction can loosen the adjuster 60 by raising the pinion away from a set of teeth configured to retain the pinion and prevent its rotation in the second direction. The pinion can be operable to rotate in the second direction and loosen the rack, which can loosen the dampening fit system 40, proportionate to the amount of rotation of the dial 65. The adjuster 60 may be loosened incrementally, tightened incrementally, or both. The adjuster has first, second, third, and fourth incremental notches to allow the user to tighten the adjuster, and for the adjuster to remain tight.

Other embodiments may employ an adjuster 60 configured to tighten, loosen, or both, a cable and drum of a dampening fit system 40 with a rotation of a dial 65 of the adjuster 60. Rotating the dial 65 in a first direction can wind one or more cables around a drum, which can tighten the fit of the helmet 20. The adjuster 60 may also comprise teeth configured to prevent or limit slipping and loosening of the adjuster 60 when the user 10 wants it to remain tight. Rotating the dial 65 in a second direction can loosen the adjuster 60 by raising the drum away from a set of teeth configured to retain the drum and prevent its rotation in the second direction. The drum can be operable to rotate in the second direction and unwind one or more cables from the drum, which can loosen the dampening fit system 40. The adjuster 60 may be loosened incrementally, tightened incrementally, or both, proportionate to the amount of rotation of the dial 65. The adjuster has first, second, third, and fourth incremental notches to allow the user to tighten the adjuster, and for the adjuster to remain tight. In further embodiments, an adjuster 60 may tighten, loosen, or both, a capstan, a band and drum, a worm and gear, a screw and nut, or any other suitable mechanism.

Accordingly, the dampening fit system 40 can be configured to dampen movement between helmet 20 and head 15 and promote increased ventilation of air by reducing the surface area in contact with head 15. The angle θ between cantilevered support arm 55 and pod 52 combined with the flexibility and material properties of frame 50 can allow for dampening of movements between head 15 and helmet 20. Additionally, adjuster 60 can be lifted away from head 15, reducing the surface area in contact with head 15, and thereby promoting increased air circulation that can dissipate heat better than existing designs. Further, the cantilevered shape of support arm 55 and pod 52 provide a spring-like effect in a manner that reduces the risk of catching hair within the spring mechanism (especially when compared to coiled springs). Constructing dampening fit system 40 to comprise a distance 48 can also improve comfort of user 10 by increasing air circulation through reduces surface area in contact with head 15 and may improve movement and dampening behavior over existing designs.

Where the above examples, embodiments and implementations reference examples, it should be understood by those of ordinary skill in the art that other helmet and manufacturing devices and examples could be intermixed or substituted with those provided. In places where the description above refers to particular embodiments of helmets and customization methods, it should be readily apparent that a number of modifications may be made without departing from the spirit thereof and that these embodiments and implementations may be applied to other to helmet customization technologies as well. Accordingly, the disclosed subject matter is intended to embrace all such alterations, modifications and variations that fall within the spirit and scope of the disclosure and the knowledge of one of ordinary skill in the art.

Any dimensions presented in this document are for example only and not a limitation on the scope of this disclosure. It will be understood that embodiments are not limited to the specific components disclosed herein, as virtually any components consistent with the intended operation of the method or system may be utilized. Accordingly, for example, although particular materials, structures, and couplings may be disclosed, such components may comprise any shape, size, style, type, model, version, class, grade, measurement, concentration, material, weight, quantity, or the like consistent with the intended operation of a dampening fit system 40 configured for use with a helmet 20.

Accordingly, the components defining any dampening fit system 40 embodiment may be formed of any of many different types of materials or combinations thereof that can readily be formed into shaped objects provided that the components selected are consistent with the intended operation of a dampening fit system 40 embodiment. For example, the components can comprise one or more: polymers such as thermoplastics (such as ABS, Fluoropolymers, Polyacetal, Polyamide; Polycarbonate, Polyethylene, Polysulfone, or other similar material), thermosets (such as Epoxy, Phenolic Resin, Polyimide, Polyurethane, Silicone, or other similar material); glasses (such as quartz glass), carbon-fiber, aramid-fiber, any combination thereof, or other similar material; composites; metals, such as zinc, magnesium, titanium, copper, lead, iron, steel, carbon steel, alloy steel, tool steel, stainless steel, brass, tin, antimony, pure aluminum, 1100 aluminum, aluminum alloy, a or other similar materials; alloys, such as aluminum alloy, titanium alloy, magnesium alloy, copper alloy, any combination thereof, or other similar materials; and one or more of any of the above with one or more or other similar material.

Various dampening fit system 40 and helmet 20 embodiments may be manufactured using conventional procedures as added to and improved upon through the procedures described here. Some components may be manufactured simultaneously and integrally joined with one another, while other components may be purchased pre-manufactured or manufactured separately and then assembled with the integral components.

Accordingly, manufacture of these components separately or simultaneously may involve one or more of extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, or other similar process. If any of the components are manufactured separately, they may then be coupled with one another in any suitable manner, such as with adhesive, a weld, a fastener (e.g., a bolt, a nut, a screw, a nail, a rivet, a pin), wiring, any combination thereof, and/or the like for example, depending on, among other considerations, the particular material forming the components.

Upon reading the teachings of this specification, those with ordinary skill in the art will appreciate that, under certain circumstances, considering issues such as changes in technology, user requirements, etc., a variety of fastening devices may be used to affix, couple, or releasably couple, (as those words are used herein) one or more components of the present disclosure. These fastening devices may comprise one or more of the following: adhesives, belts, bolts, buckles, clasps, latches, locks, screws, snaps, clamps, connectors, couplings, ties, or other fastening means yet to be developed.

Likewise, upon reading the teachings of this specification, those with ordinary skill in the art will appreciate that, under certain circumstances, considering issues such as changes in technology, subject requirements, etc., a variety of fastening devices, such as adhesives, belts, bolts, buckles, clasps, latches, locks, screws, snaps, clamps, connectors, couplings, ties or other fastening means yet to be developed may be used in lieu of—or in conjunction with—any of the fasteners or fastening means discussed above.

It will be understood that the assembly of dampening fit system 40 embodiments are not limited to the specific order of steps as disclosed in this document. Any steps or sequence of steps of the assembly of dampening fit system 40 embodiments indicated herein are given as examples of possible steps or sequence of steps and not as limitations, since various assembly processes and sequences of steps may be used to assemble dampening fit system 40 embodiments.

In places where the description above refers to particular embodiments, it should be readily apparent that a number of modifications may be made without departing from the spirit thereof and that these embodiments may be applied to other embodiments disclosed or undisclosed. The accompanying claims are intended to cover such modifications as would fall within the true spirit and scope of the disclosure set forth in this document. The presently disclosed embodiments are, therefore, to be considered in all respects as illustrative and not restrictive, the scope of the disclosure being indicated by the appended claims rather than the foregoing description. All changes that come within the meaning of and range of equivalency of the claims are intended to be embraced therein.

What is claimed is:

1. A fit system for a helmet comprising:

an adjuster comprising an adjustment wheel rotatably engaged with a left side belt and a right side belt, wherein rotation of the adjustment wheel in a first direction reduces an adjustable inner circumference of the belts and rotation of the adjustment wheel in a second direction increases the adjustable inner circumference of the belts, the adjuster further comprising an adjuster housing comprising at least one width adjustment track on a back surface of the adjuster housing, the at least one width adjustment track comprising a plurality of incremental notches spaced along a length of the at least one width adjustment track;

a first pod comprising a first support arm extending away from the first pod at an outer end of the first pod, the first pod directly attached to the at least one width adjustment track through a first support arm, and indirectly attached to the at least one width adjustment track through the right side belt so that there are two attachment points between the first pod and the adjuster; and a second pod comprising a second support arm extending away from the second pod at an outer end of the second pod, the second pod directly attached to the at least one width adjustment track through a second support arm, and indirectly attached to the at least one width adjustment track through the left side belt so that there are two attachment points between the second pod and the adjuster;

wherein the first pod is directly attached to the second pod through a hanger adapted to allow for adjustment of a lateral offset between the first pod and the second pod.

2. The fit system of claim 1, wherein:

the first support arm comprises a first end that is one piece with the first pod and a second end opposite the first end cantilevered away from the first pod and coupled to the width adjustment track; and the second support arm comprises a first end that is one piece with the second pod and a second end opposite the first end cantilevered away from the second pod and coupled to the width adjustment track.

3. The fit system of claim 1, wherein the left belt and the right belt are each adapted to be coupled to a helmet such that the movement of the adjustment wheel changes a position of the left and right belts with respect to the adjustment wheel and further changes an adjustable inner circumference of the belts.

4. The fit system of claim 1, wherein a lateral offset between the first pod and the second pod comprises a distance in a range of 0-70 millimeters.

5. The fit system of claim 1, further comprising a plane defined by the first pod and a plane defined by the first support arm, wherein the first pod is positioned in relation to the first support arm at an angle in a range of 0-60 degrees.

6. The fit system of claim 1, further comprising:

a first pad coupled to a front surface of the first pod; and a second pad coupled to a front surface of the second pod.

7. The fit system of claim 1, wherein at least one of a perpendicular distance between the first pod and the adjuster and a perpendicular distance between the second pod and the adjuster is in a range of 0-30 millimeters.

8. A fit system for a helmet comprising:

an adjuster configured to adjust an inner circumference of a fit system for a helmet through extending and retracting left and right belts engaged by the adjuster to increase and decrease the inner circumference of the fit system;

a first pod comprising a first support arm extending away from an end of the first pod, the first support arm selectively attached to and detachable from the adjuster at a first incremental notch on a back surface of the adjuster, the adjuster further comprising at least a second incremental notch on the back surface of the adjuster adjacent the first incremental notch;

a second pod comprising a second support arm extending away from an end of the second pod, the second support arm selectively attached to and detachable from the adjuster at a third incremental notch on the back surface of the adjuster, the adjuster further comprising at least a fourth incremental notch on the back surface of the adjuster adjacent the third incremental notch, the second pod comprising a lateral offset from the first pod; and a hanger flexibly attached between the first pod and the second pod;

wherein attachment of the first support arm and the second support arm to the first incremental notch and third incremental notch, respectively, establishes a first perpendicular distance between the adjuster and the first and second pods, and attachment of the first support arm and the second support arm to the second incremental notch and fourth incremental notch, respectively, establishes a second perpendicular distance, different from the first perpendicular distance, between the adjuster and the first and second pods.

9. The fit system of claim 8, wherein:

the first support arm comprises a first end that is one piece with the first pod and a second end opposite the first end cantilevered away from the first pod and coupled to the adjuster; and the second support arm comprises a first end that is one piece with the second pod and a second end opposite the first end cantilevered away from the second pod and coupled to the adjuster.

10. The fit system of claim 9, wherein:

the hanger comprises a first portion coupled to the first pod; and the hanger comprises a second portion coupled to the second pod.

11. The fit system of claim 8, wherein at least one of the first perpendicular distance and the second perpendicular distance comprises a distance in a range of 0-30 millimeters.

12. The fit system of claim 8, further comprising an angle between a plane defined by the first pod and a plane defined by the first support arm, the angle in a range of 0-60 degrees.

13. A fit system for a helmet comprising:

an adjuster comprising an adjustment wheel rotatably engaged with both a left side belt and a right side belt, each of the left side belt and the right side belt configured to couple to a surface of a helmet, wherein rotation of the adjustment wheel in a first direction reduces an adjustable inner circumference of the belts and rotation of the adjustment wheel in a second direction increases the adjustable inner circumference of the belts, the adjuster further comprising an adjuster housing retaining the adjustment wheel and a housing cover on a back surface of the adjuster housing, the housing cover comprising a left width adjustment track on a left side of the back surface of the adjuster housing and a right width adjustment track on a right side of the back surface of the adjuster housing, each of the left and right width adjustment tracks having a continuous opening through the housing cover and comprising at least first and second incremental notches spaced along a length of each width adjustment track;

a first pod comprising a first support arm extending toward the right width adjustment track from an outer end of the first pod, the first support arm attached to the first incremental notch on the right width adjustment track and configured for selective detachment from the first incremental notch and attachment to the second incremental notch on the right width adjustment track, the first pod is only directly attached to the adjuster housing only through the first support arm, wherein selective attachment of the first support arm to the first incremental notch of the right width adjustment track establishes a first perpendicular distance between the first pod and the adjuster, and selective attachment of the first support arm to the second incremental notch of the right width adjustment track establishes a second perpendicular distance between the first pod and the adjuster different from the first perpendicular distance;

a second pod comprising a second support arm extending toward the left width adjustment track from an outer end of the first pod, the second support arm attached to the first incremental notch on the left width adjustment track and configured for selective detachment from the first incremental notch and attachment to the second incremental notch on the left width adjustment track, the second pod is only directly attached to the adjuster housing through the second support arm, wherein selective attachment of the second support arm to the first incremental notch of the left width adjustment track establishes a first perpendicular distance between the second pod and the adjuster, and selective attachment of the second support arm to the second incremental notch of the left width adjustment track establishes a second perpendicular distance between the second pod and the adjuster different from the first perpendicular distance; and a hanger flexibly attached to the first pod and the second pod.

14. The fit system of claim 13, wherein:

the hanger comprises a first portion coupled to an inner portion of the first pod; and the hanger comprises a second portion coupled to an inner portion of the second pod.

15. The fit system of claim 13, wherein a lateral offset between the first pod and the second pod comprises an adjustable distance in a range of 0-70 millimeters.

16. The fit system of claim 13, wherein at least one of the first perpendicular distance between the first pod and the adjuster and the first perpendicular distance between the second pod and the adjuster comprises a distance in a range of 0-30 millimeters.

17. The fit system of claim 13, further comprising a plane defined by the first pod and a plane defined by the first support arm, wherein the first pod is positioned in relation to the first support arm at an angle in a range of 0-60 degrees.

* * * * *